US005540568A

United States Patent [19]

Rosen et al.

[11] Patent Number: 5,540,568

[45] Date of Patent: Jul. 30, 1996

[54] DISPOSABLE ROLLING DIAPHRAGM FILLING UNIT

[75] Inventors: Robert Rosen, Owings Mills; William M. Hamilton, Baltimore, both of Md.

[73] Assignee: National Instrument Co., Inc., Baltimore, Md.

[21] Appl. No.: 312,613

[22] Filed: Sep. 27, 1994

Related U.S. Application Data

[63] Continuation-in-part of Ser. No. 905,541, Jul. 26, 1993, abandoned.

[51] Int. Cl.[6] ..... F04B 43/06

[52] U.S. Cl. ..... 417/395; 417/454; 417/566; 417/53; 92/98 R

[58] Field of Search ..... 417/394, 395, 417/413.1, 454, 559, 566, 569, 53; 92/128, 98 D, 98 R

[56] References Cited

U.S. PATENT DOCUMENTS

| | | | |
|---|---|---|---|
| 2,549,231 | 4/1951 | Perkins | 417/395 |
| 2,717,556 | 9/1955 | Bartou | 417/568 |
| 3,212,446 | 10/1965 | Golden et al. . | |
| 3,496,874 | 2/1970 | Findlay | 417/413.1 |
| 3,701,614 | 10/1972 | Guidicelli | 417/413.1 |
| 3,771,907 | 11/1973 | Neumann et al. | 417/454 |
| 3,880,053 | 4/1975 | Trechsel et al. . | |
| 4,212,416 | 7/1980 | Bennett . | |
| 4,265,600 | 5/1981 | Mandroian . | |
| 4,334,838 | 6/1982 | Fessler et al. . | |
| 4,569,378 | 2/1986 | Bergandy . | |
| 4,778,356 | 10/1988 | Hicks . | |
| 4,948,349 | 8/1990 | Koiwa . | |
| 4,971,523 | 11/1990 | Wacker et al. | 417/413.1 |
| 5,154,589 | 10/1992 | Ruhl et al. . | |
| 5,282,724 | 2/1994 | Reynolds | 417/454 |

FOREIGN PATENT DOCUMENTS

| | | |
|---|---|---|
| 1219448 | 6/1966 | Germany . |

*Primary Examiner*—Charles Freay
*Attorney, Agent, or Firm*—Barnes & Thornburg

[57] ABSTRACT

The head, rolling diaphragm, intake and discharge ports form a single module, separate and easily removable from the principle cylinder of a rolling diaphragm filling unit. The rolling diaphragm may be fixed or removably attached to the head. Intake and discharge valves of various types may be mounted directly in the head, or may be mounted remote to the head module and fluidly connected directly to the head by tubing. Flanges of the rolling diaphragm provide an air and liquid tight seal between the head and base and removably attached to the head so as to facilitate visual inspection of the product contact surfaces of the head cavity prior to clamping the head module to the base.

44 Claims, 5 Drawing Sheets

DISPOSABLE ROLLING DIAPHRAGM FILLING UNIT

CROSS-REFERENCE

This is a continuation-in-part of U.S. patent application Ser. No. 08/905,541 filed Jul. 26, 1993 now abandoned.

BACKGROUND AND SUMMARY OF THE INVENTION

The present invention relates generally to filling machines and more specifically to rolling diaphragm filling units utilized on filling machines.

Filling machines in which one or more containers such as, bottles, ampules, etc. are individually or simultaneously filled by filling units from a respective nozzle to be lowered into the containers, or held above the containers are known in the art, for example, as described in Bennett U.S. Pat. No. 4,212,416. The filling units, sometimes referred to as pumps or metering units, have generally included a piston-cylinder arrangement wherein the piston rod is connected to a piston to both push and pull the piston during a reciprocal intake and discharge stroke of the filling unit.

The filling units or pumping units, generally including five major components, mainly a head, a piston, a cylinder, an inlet valve, and an outlet valve. The head has an internal chamber connecting the cylinder and inlet and outlet valves mounted at appropriate ports. Generally the head has been uniquely designed to receive specific pistons and cylinders, inlet valves and outlet valves. A more universal design is disclosed in Ruhl et al U.S. Pat. No. 5,154,589. The inlet and outlet valves are shown as check valves, spool valves, and duck-bill valves. The piston includes a standard piston with a dynamic seal as well as a rolling diaphragm pump. A further example of a rolling diaphragm pump which allows controlling the amount of material dispensed through the stroke of the diaphragm is shown in Bergandy U.S. Pat. No. 4,569,378. All three of the above patents are incorporated herein by reference.

Whereas the Ruhl, et al. U.S. Pat. No. 5,154,589 is designed for ease of assembly, there is still a need to flush the filling unit when changing materials. Pharmaceutical manufacturers are seeking to utilize disposable, instead of reusable, product contact parts in the processing equipment to eliminate the possibility of cross contamination. The early rolling diaphragm pumps of the Bergandy U.S. Pat. No. 4,569,378 have the advantage of no frictional contact parts in the material flow path, minimal particulate generation and a high degree of accuracy. Although it has been designed with reusable parts, it has not utilized disposable parts. Also, some users have cited an excessive number of working parts to assemble or disassemble the pump even for the reusable product contact parts.

When the pump is disassembled, the head and diaphragm separate from each other and therefore the contents of the working chamber between the head and the diaphragm escape. This provides a very messy situation. Also depending upon the material being dispensed, this could provide a very dangerous situation for the operator who is reconditioning the pump.

Although positive displacement piston pumps are used extensively throughout the pharmaceutical industry for fluid metering, there are considerable ongoing costs associated with these units in sterile applications. For the most part, these costs are related to disassembly, sterilization, and reassembly of the pumps at frequent intervals. When a wide variety of pump sizes are used on multiple machines, the control logistics can become quite elaborate and costly, due to the number of possible combinations of components.

Peristaltic type pumps are also used throughout the pharmaceutical industry for fluid metering. Although this type of pump offers the advantages of no frictional contact parts in the material flow path and disposable product contact parts, experience has shown that peristaltic pumps do not offer the filling accuracy and speed that is possible with rolling diaphragm pumps.

Thus, it is an object of the present invention to provide a rolling diaphragm pump with a minimal number of parts which facilitates easier assembly and disassembly.

Another object of the present invention is to provide a rolling diaphragm filling unit utilizing disposable product contact parts to eliminate the possibility of cross contamination between different products.

A further object of the present invention is to provide a rolling diaphragm filling unit utilizing disposable product contact parts that may be pre-packaged and/or pre-sterilized.

An even further object of the present invention is to provide a rolling diaphragm filling unit which is conducive to assembly, disassembly, and maintenance by inexperienced personnel.

A still further object of the present invention is to reduce the initial cost and ongoing maintenance expense of rolling diaphragm pumps to the extent that their use can extend beyond sterile filling applications into the area of general purpose fluid metering.

A still even further object of the present invention is to provide a rolling diaphragm filling unit wherein the head and rolling diaphragm are removed without the escape of any material in the working chamber.

These and other objects are achieved by combining the head, rolling diaphragm, intake and discharge ports into a single module, separate and easily removable from the principle cylinder of a rolling diaphragm filling unit.

Intake and discharge valves of various types may be mounted directly in the head, or may be mounted remote to the head module and fluidly connected directly to the head by means of tubing. The head may include separate intake and discharge ports or a single port may be used, in conjunction with a T-connector, with intake and discharge valves mounted directly or remotely to the tee on opposite sides of the port. Tapered flanges on the head module and base facilitate the clamping together of these units by a ring-type, quick-disconnect clamp. The flanges of the rolling diaphragm provide an air and liquid tight seal between the head and base. Although the rolling diaphragm is a part of the head module, it may be removably attached to the head so as to facilitate visual inspection of the product contact surfaces of the head cavity prior to fixing the diaphragm to the head and clamping the head module to the base. This may be achieved by a friction fit between a flange on the diaphragm and a recess in the head and/or by a snap-on clamp. The diaphragm may be fixedly attached to the head by an adhesive. The head module, including the porting arrangement, and the attached rolling diaphragm, comprise a disposable module which includes all of the pump surfaces that come into contact with the fluid product. The base contains a port to provide vacuum assist to ensure full convolution of the rolling diaphragm. The base, comprised of the cylinder and piston arrangement, are the permanent elements of the filling unit and are fabricated of metal, usually stainless steel, and other non-disposable type materials. The disposable head module is fabricated of plastic and/or other economical material.

Other objects, advantages and novel features of the present invention will become apparent from the following detailed description of the invention when considered in conjunction with the accompanying drawings.

DESCRIPTION OF THE PREFERRED EMBODIMENTS

Figure 1:
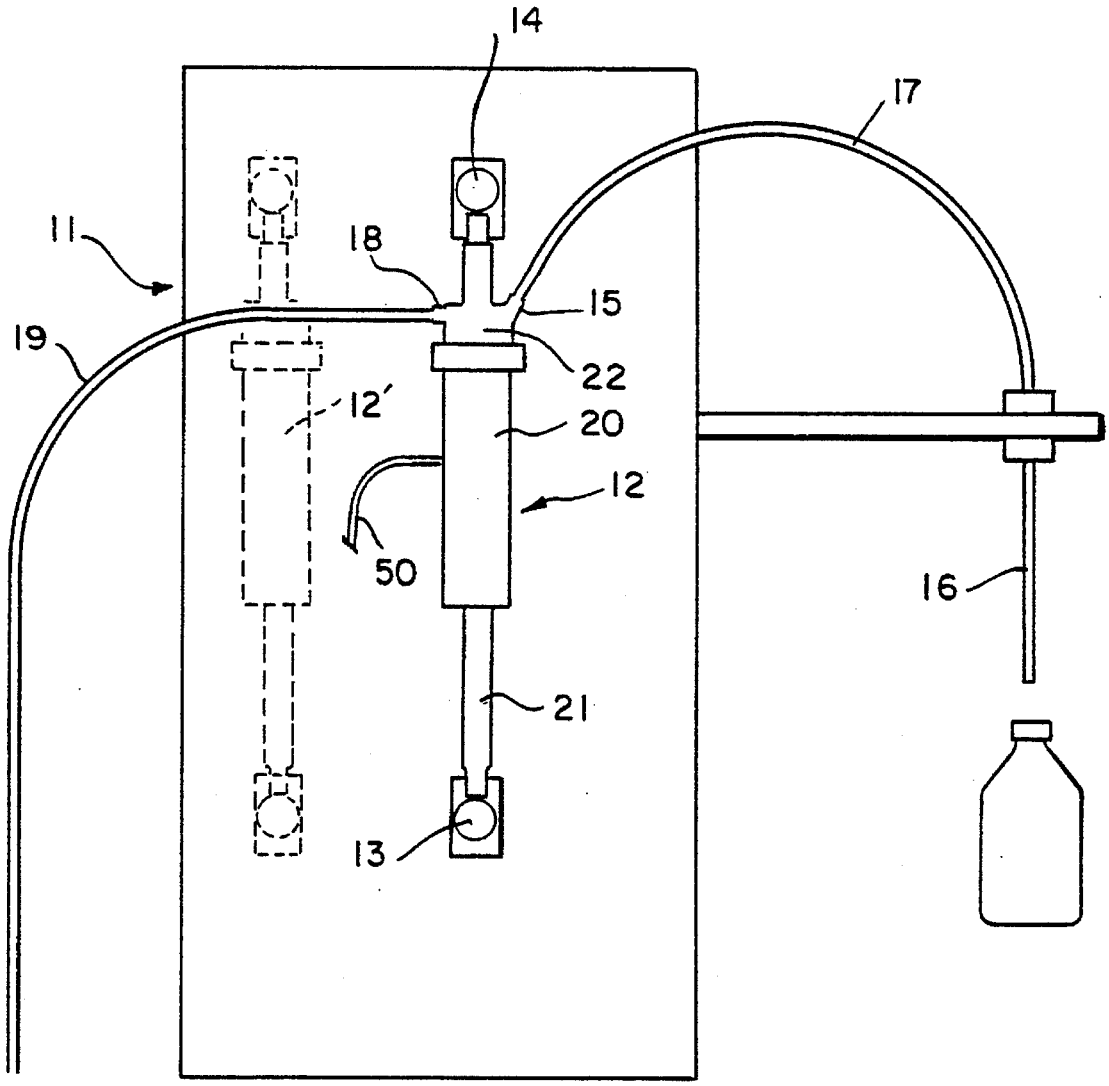
FIG. 1 is a schematic view of a filling machine including an individual rolling diaphragm filling unit according to the principles of the present invention.

FIG. 1 shows a filling machine 11 with a single filling unit 12 connected thereto. Embodiment of filling unit 12 includes a base or cylinder 20 and a head 22. A piston rod 21 is connected to a rotating eccentric or linear reciprocating drive mechanism 13, so as to provide the piston rod with a reciprocating motion. The top of the filling unit is connected to a fixed post or clamp 14. Discharge port 15 is connected to a nozzle 16 via discharge tubing 17. Intake port 18 is connected to supply source via intake tubing 19. Port 50 is connected to a source of vacuum. The filling machine of FIG. 1 is generally described in the Bennett U.S. Pat. No. 4,212,416 which is incorporated herein by reference. As in the Bennett patent, more than one filling unit may be on the filling machine, a second of which is illustrated in phantom as 12'. Embodiments of the filling unit 12 and parts thereof according to the present invention are illustrated in detail in FIGS. 2, 4, 5 and 7 disassembled, and in FIGS. 3, 6 and 8 assembled.

Figure 2:
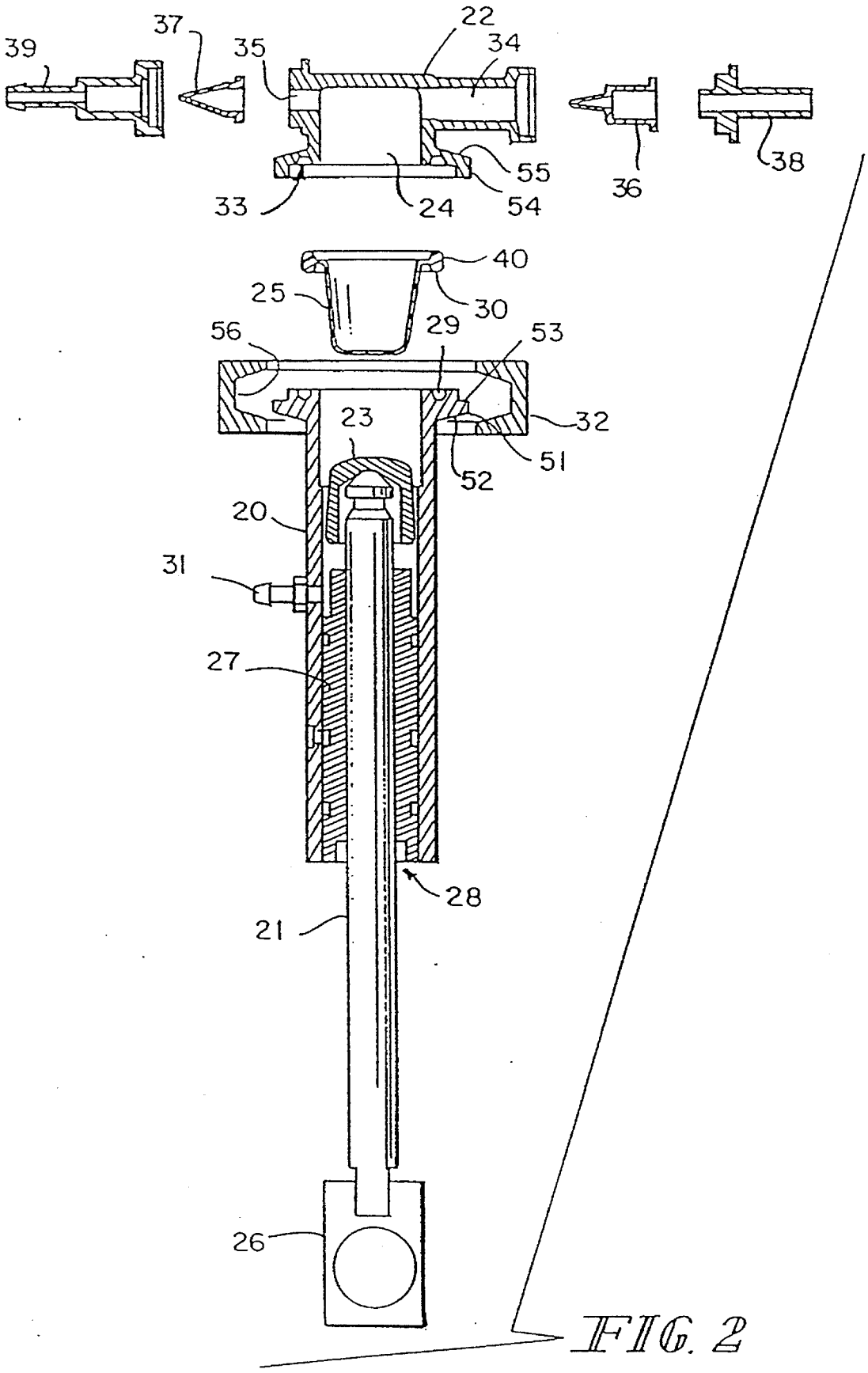
FIG. 2 is a disassembled, cross-sectional view of a rolling diaphragm filling unit according to the principles of the present invention.

In FIG. 2, the base or cylinder 20 includes a piston rod 21 and a piston 23. The end of the piston rod 21 supports the piston 23 and drives the piston 23 into recess 24 of the head 22 and is not connected thereto. As is well known in the rolling diaphragm pump, the upward or discharge stroke of a diaphragm 25 is produced by the upward motion of the piston 23 and the downward or intake stroke of the diaphragm 25 is controlled by the differential pressure produced by a vacuum on the underside of the rolling diaphragm 25 as the piston 23 moves down. The other end of the piston rod 21 has the lower connector 26 for attachment to the drive mechanism 13 of FIG. 1. A guide 27 in the lower end of the cylinder 20 includes a seal 28 to slidably and sealingly mount the piston rod 21 to the cylinder 20. At the other end of the cylinder 20 is a recess 29 to receive the sealing ring 30 of the rolling diaphragm 25. Port 31 in the cylinder 20 connects the cylinder 20 to a source of vacuum or negative pressure to control the operation of the diaphragm 25 as explained in U.S. Pat. No. 4,569,378 which is incorporated herein by reference.

A clamp 32, for example a ring-type quick disconnect clamp, is loosely connected to the cylinder 20 and is provided to clamp the head 22 to the cylinder 20. A flange 51 on the cylinder 20 has a tapered surface 52 and a shoulder 53. The head 22 includes a flange 54 to be received on the shoulder 53 of the cylinder flange 52 and a tapered surface 55. The clamp 32 has a recess 56 for receiving the flanges 51, 54 and applying force to the tapered surfaces 52, 55.

Figure 4:
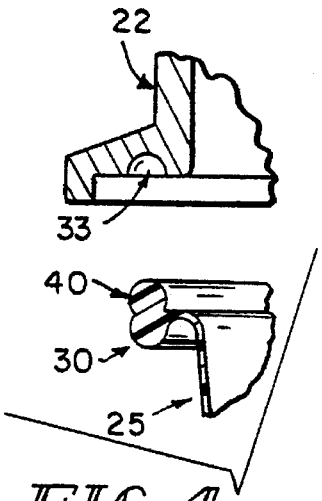
FIG. 4 is an enlarged, partial cross-sectional view of a portion of FIG. 2, further detailing an embodiment of the present invention.

The head 22 includes an internal product chamber 24 closed at one end, by the rolling diaphragm 25. A recess 33 in the face of the head 22 receives the upper flange 40 of the rolling diaphragm 25 which is removably attached thereto as shown in FIG. 4. By being removably attached to the head 22, the rolling diaphragm 25 may be removed for inspection of the interior chamber 24 and reattached thereto forming a module.

Figure 5:
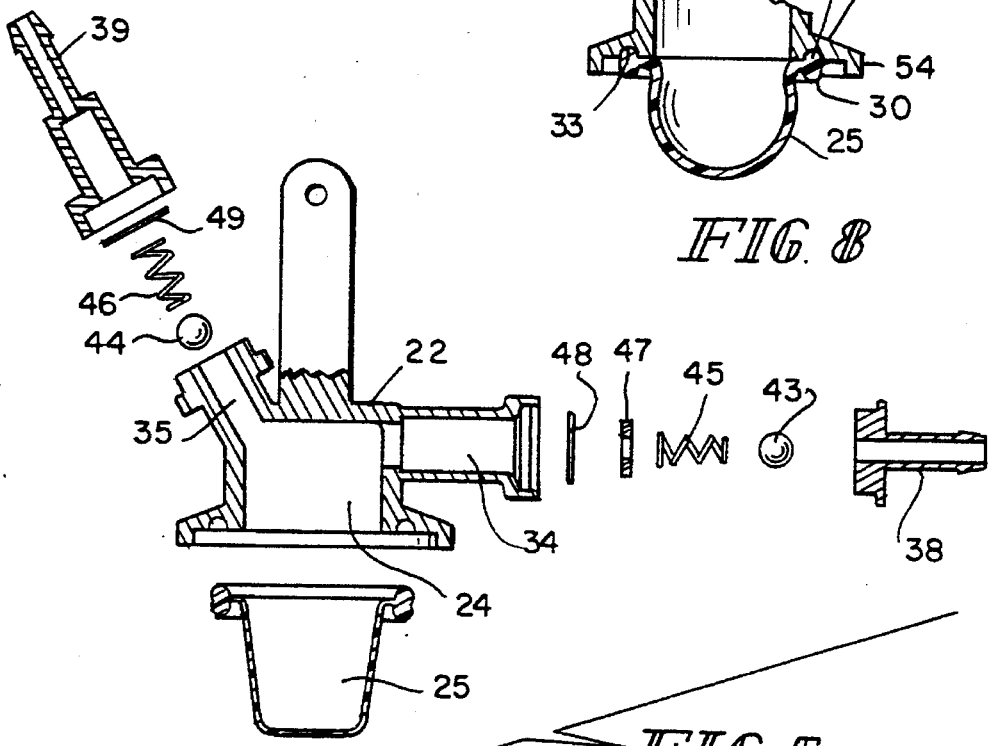
FIG. 5 is a disassembled, cross-sectional view of another embodiment of a disposable head module according to the principles of the present invention.
Figure 6:
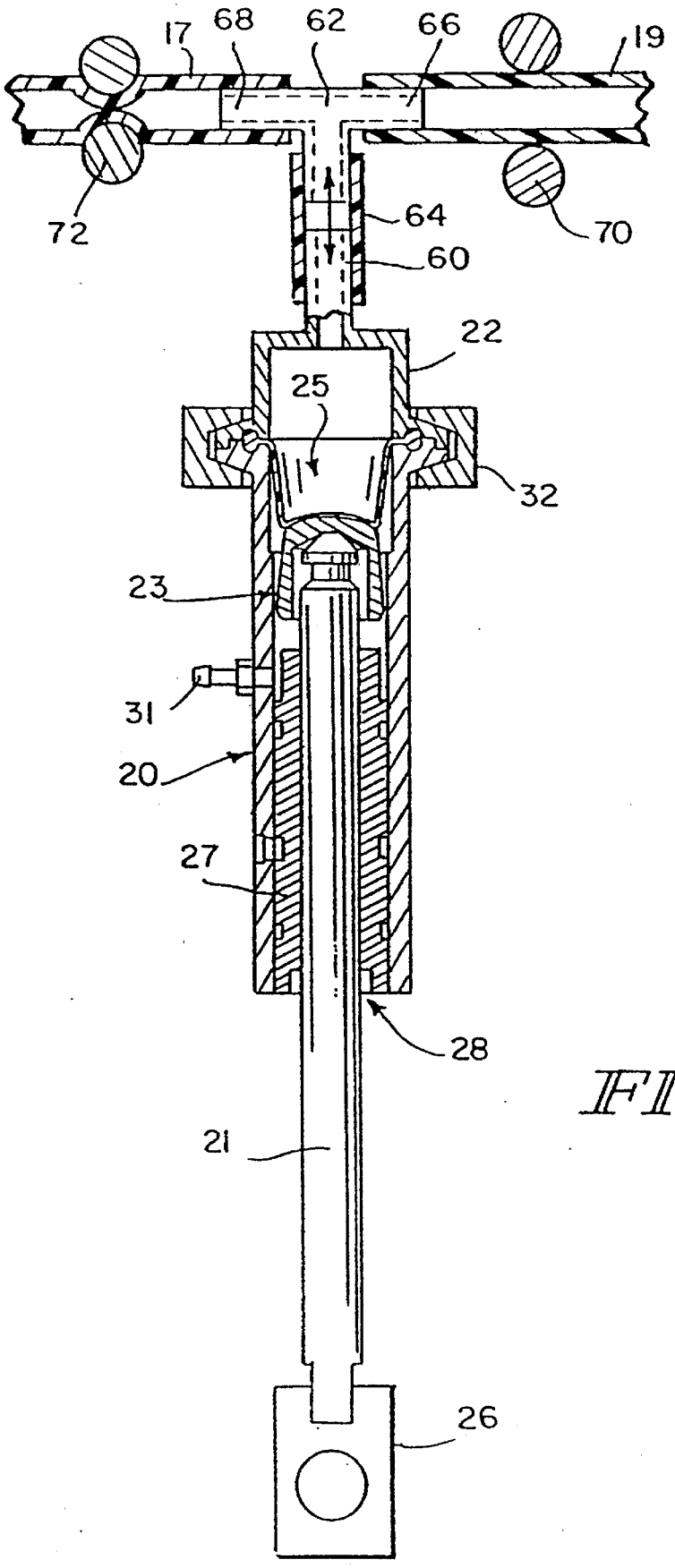
FIG. 6 is an assembled, cross-sectional view of another embodiment of a disposable head module according to the principles of the present invention.

The head 22 also includes an intake port 34 and a discharge port 35 connected to the interior chamber 24. An intake valve 36 and a discharge valve 37 are provided in the intake and discharge ports 34, 35. The example illustrated in FIG. 2 is a duck-bill valve arrangement. The duck-bill valves 36, 37 are contained between their respective valve housings 38, 39 and their respective ports 34, 35. Although duck-bill valves are shown, other valves such as ball check, may be used and formed in the ports 34, 35 with the head 22 as shown in FIG. 5. Duck-bill, ball check, or pinch clamp type valves may also be remotely connected to the head 22 via tubing. The head 22 may also be supplied with the valves 36, 37 displaced from between the ports 34, 35 and the valve housings 38, 39. The valve housings 38, 39 would be connected directly to the ports 34, 35 so as to provide for remote connecting of valves via tubing. Although FIG. 2 illustrates separate intake and discharge ports, another embodiment of the invention may be a single port used in conjunction with a T-connector, with intake and discharge valves connected integrally or remotely via tubing to the T-connector as shown in FIG. 6.

Figure 8:
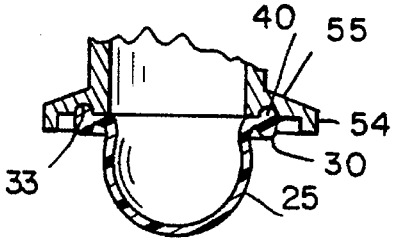
FIG. 8 is an enlarged partial cross-sectional view of the integral module of the head and diaphragm.

The head 22, the diaphragm 25, the intake and discharge valves 36, 37 and valve housings 38, 39 are a disposable integral module which is removable as a unit or module from the base 20, as shown in FIG. 8. The disposable module may be supplied to the user in a presterilized or unsterilized package ready for use. The lower flange 30 of the rolling diaphragm 25 provides an air-tight and liquid-tight seal between the head 22 and the cylinder 20.

For sterility, and for the capability of quickly changing the material being dispensed, the head 22 with its intake and discharge ports 34, 35, valves 36, 37, valve housings 38, 39 and rolling diaphragm 25, comprise an integral module to be disposed. Fixedly attaching the diaphragm 25 to the head 22 prevents the escape of any fluid from the working chamber during disassembling and disposal of the head module. Typical materials for the head 22 and integral porting are rigid plastic. Typical materials for the rolling diaphragm 25 are fabric-backed elastomer. Typical materials for the valve assemblies are dependent upon the type of valves being used, and may be elastomer, plastic or metal. The valves may be attached to the head 22 remotely by tubing or formed integrally with the head 22 depending upon the valve arrangement. The base 20, being a permanent part, and not having contact with the material being dispensed, as well as the piston assembly 21, 23, 26, 27, 28, 29, 31 and 32 may be made of stainless steel or other rigid material or from plastic. Some types of valves, such as pinch clamp type, may be remotely connected to the head 22 via tubing, and the clamping mechanism may also be a permanent assembly and not in contact with the product being dispensed as shown in FIG. 6.

Figure 3:
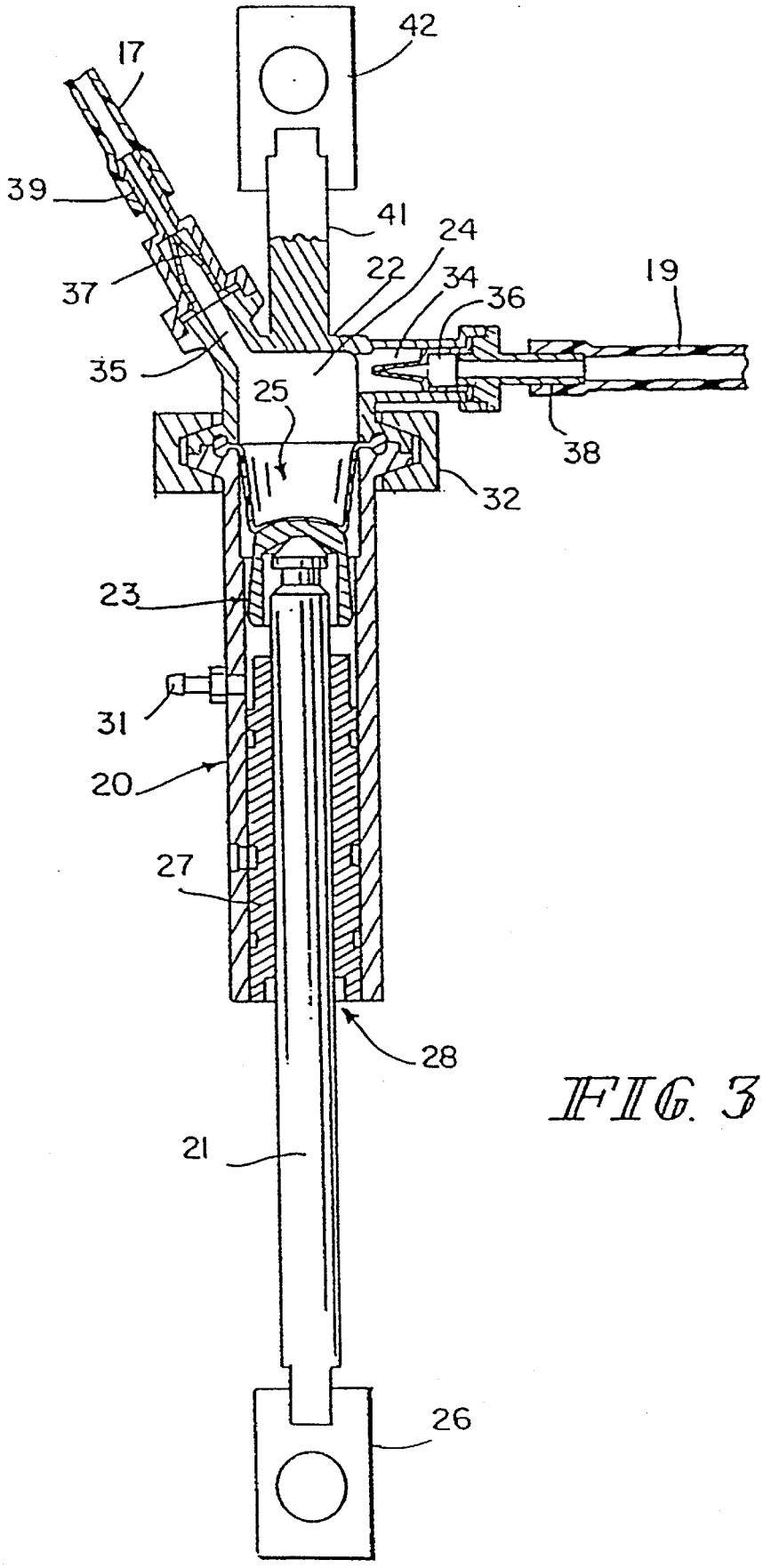
FIG. 3 is an assembled, cross-sectional view of another embodiment of a rolling diaphragm filling unit according to the principles of the present invention.

Another embodiment in the assembled version is illustrated in FIG. 3. The discharge valve 37 and port 35 are shown attached to the head 22 at an angle approaching vertical, unlike the horizontal position illustrated in FIG. 2. This angle, as well as the position around the circumference of the head 22 may vary. As a further distinction from FIG. 2, the head 22 incorporates a stem 41 on top of the head 22 so as to accommodate the upper connector 42 which is a means of mounting the upper end of the filling unit to the fixed post 14 of FIG. 1.

As in the embodiment of FIG. 2, the head 22, the rolling diaphragm 25, the intake and discharge valves 36, 37 and valve housings 38, 39 as well as the nozzle 16 from FIG. 1 form a disposable integral module which is removable as a unit from the base 20. Upon changing the product or for any other reason, the head 22 with its elements, as well as the intake and discharge tubing 19, 17 and nozzle 16 are removed from the base 20. A new head 22 with its elements, as well as new tubing 19, 17 and new nozzle 16 is removably attached to the base 20. The intake and discharge tubing 19, 17 and nozzle 16 may also be supplied preconnected to the head 22, and may be a part of a package to form a complete product contact disposable module. Upon attaching the new module to the base 20, the clamp 32 is secured, and the unit is ready for operation.

FIG. 4 illustrates the preferred method of removably attaching the rolling diaphragm 25 to the head 22. A recess 33 is provided in the face of the head 22 to removably receive the upper flange 40 of the rolling diaphragm 25. The recess 33 is configured in such a way to conform to the contour of the upper flange 40 in a size to size or friction fit. The upper flange 40 is pressed into the recess 33, compressing the elastomeric flange 40 in the said recess. The configuration of the recess 33 and the upper flange 40 are provided to form an air-tight and liquid-tight seal between the head 22 and the rolling diaphragm 25, and to also provide for removable retention of the upper flange 40 in said recess 33. The same friction fit may be used with bottom flange 30 and recess 29 in the base 20, as shown in FIG. 2.

Another embodiment of the disposable head module in the disassembled form is illustrated in FIG. 5. The valve type, unlike the duck-bill valves of FIGS. 2 and 3 is a ball check. The head 22 includes in intake port 34 and a discharge port 35 connected to the interior chamber 24. An intake valve ball 43, valve spring 45, spring retainer 47, and valve seal 48 are provided in the intake port 34, and a discharge ball 44, valve spring 46, and valve seal 49 are provided in the discharge port 35.

As a further distinction in FIG. 5, the head 22 does not include the recess 33 and the upper flange 40 of the rolling diaphragm 25 has been deleted. An adhesive 80 has been provided on the rolling diaphragm 25 to fixedly attach the diaphragm to the head 22. The adhesive may be applied by the assembler of the head module or may be pre-applied to the diaphragm and have a release sheet thereon so that it can be applied after inspection and sterilization. It should also be noted that the adhesive may be provided on the upper flange 40 to fixedly secure the upper flange 40 to the recess 33. Thus, a press fit will not be needed or it can be used in combination with a press fit. A typical adhesive would be a silicone adhesive.

Another embodiment in the assembled version is illustrated in FIG. 6. The head 22 is modified to have a single entry port 60 connected to a T-connector 62 via sleeve 64. The intake port 66 and the discharge port. 68 are provided on the T-connector 62 and are connected to a supply via tubes 19 and the nozzle via discharge tube 17 respectively. The T-connector 62, sleeve 64, entry port 60, intake port 66 and discharge port 68 may also be formed as a single integral part of the head 22. An inlet pinch valve 70 receives the supply tubing 19 and the discharge pinch valve 72 receives the discharge tubing 17. The pinch valves 70 and 72 are mounted to the filling unit 11 and are not part of the disposable unit. Since they do not come into contact with the supply material, they do not have to be replaced. The tubing 17 and 19 would be replaced as part of the head/diaphragm module as well as the nozzle with a change of product. The filling unit is shown at the end of a intake cycle.

As in the embodiment of FIG. 6, the head 22, the diaphragm 25, and the porting structure 60, 62, 64, 66, and 68 are formed as an integral module removable as a unit from the base 20. Upon changing the product or for any other reason, the head 22 with its elements are removed from the base 20 as well as the tubing 17, 19 and nozzle 16 (FIG. 1). A new head 22 is removably mounted to the base 20 and new tubing 17, 19 connect the nozzle and the supply through the pinch valves 70 and 72 to the ports 66 and 68 respectively. Upon securing the clamp 32, the unit is ready for operation.

Figure 7:
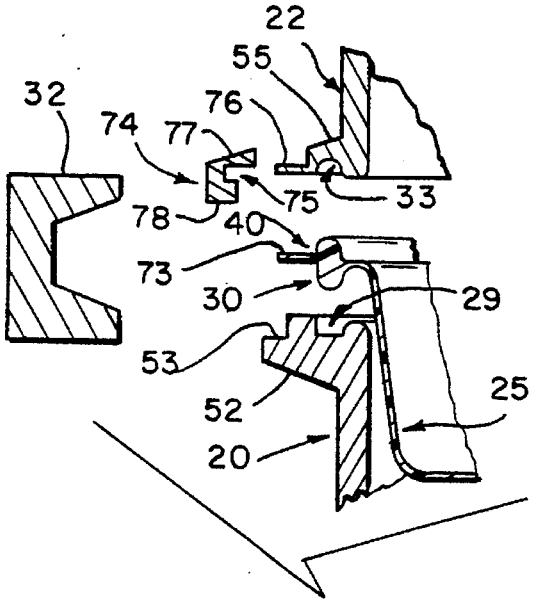
FIG. 7 is an enlarged, partial cross-sectional view of another embodiment of the present invention.

FIG. 7 illustrates an alternate method of removably attaching the rolling diaphragm 25 to the head 22. A radial side flange 73 is formed as part of the diaphragm 25 and is clamped in a compression manner in the recess 75 of the ring-type snap-on clamp 74 with a flange 76 of the head 22. The tapered surface 77 of the clamp 74 is an extension of the tapered surface 55 of the head 22 and is received in recess 56 of clamp 32 of FIG. 2. The lower portion 78 of clamp 74 is received on shoulder 53 of the cylinder 20. The FIG. 7 also shows another configuration of the upper flange 40 and recess 33 in the head 22 which may be used with or without the side flange 73 and clamp 74. Also the configuration of the upper flange 40 and recess 33 in the head 22 shown in FIG. 4 may be used with or without the side flange 73 and clamp 74.

Although the present invention has been described and illustrated in detail, it is to be clearly understood that the same is by way of illustration and example only, and is not be taken by way of limitation. The spirit and scope of the present invention are to be limited only by the terms of the appended claims.

What is claimed:

1. A filling unit for transporting a material from a source to a container comprising:

a housing having a base and a head mounted on said base;

a flexible rolling diaphragm fixedly attached to said head and positioned to abut said base in a releasable sealable manner to define between said diaphragm and said head a working chamber in said housing;

drive means within said base for reciprocating said diaphragm;

port means on said head for providing material intake and discharge ports for said working chamber; and said head with fixedly attached diaphragm and port means forming an integral module removable as a unit from said base without detachment of the diaphragm.

2. A filling unit according to claim 1 wherein said diaphragm can be detached from its fixed attachment to said head to allow inspection of the interior of said working chamber and reattachment prior to mounting said head to said base.

3. A filling unit according to claim 2 wherein said head includes a recess which provides a frictional fit for a flange of said diaphragm to be inserted to form said attachment of said diaphragm to said head.

4. A filling unit according to claim 1 wherein an intake valve is provided for said intake port and a discharge valve is provided for said discharge port.

5. A filling unit according to claim 4 wherein said intake and discharge valves are mounted on said head.

6. A filling unit according to claim 4 wherein said intake and discharge valves are not mounted on said head and are fluidly connected to said head by tubing.

7. A filling unit according to claim 6 wherein said tubing is connected to said head by a T-connector.

8. A filling unit according to claim 1 wherein said base includes a vacuum port and seal means for sealing said base.

9. A filling unit according to claim 1 wherein said diaphragm is attached to said head by an adhesive.

10. A filling unit according to claim 1 wherein said drive means includes a piston and a piston rod in said housing with a first end of said piston rod cooperating with said piston and a second end of said piston rod slidably extending from said base.

11. A filling unit according to claim 1 wherein said body is metal and said head is plastic.

12. A filling unit according to claim 1 wherein said body and said head are plastic.

13. A filling unit according to claim 1 wherein said filling unit transports a measured volume of material per cycle of operation.

14. A filling unit for transporting a material from a source to a container comprising:

a housing having a base and a head mounted on said base;

a flexible rolling diaphragm;

a first clamping means for removably attaching said diaphragm to said head;

a second clamping means for removably attaching said head and affixed diaphragm to said base to define between said diaphragm and said head a working chamber in said housing;

drive means within said base for reciprocating said diaphragm;

port means on said head for providing material intake and discharge ports for said working chamber; and said head with fixedly attached diaphragm, first clamping means and port means forming an integral module removable as a unit from said base without detachment of the diaphragm.

15. A filling unit according to claim 14 wherein said diaphragm includes a radial side flange.

16. A filling unit according to claim 14 wherein said module and said base each include a flange having a tapered surface received in a recess of said second clamping means.

17. A filling unit according to claim 16 wherein said first clamping means includes a portion of said tapered surface of said module received in said recess of said second clamping means.

18. A filling machine having a plurality of filling units, nozzles and a source of material connected to said filling units, and means for operating said filling units, said filling units each comprise:

a housing having a base and a head mounted on said base;

a flexible rolling diaphragm fixedly attached to said head and positioned to abut said base in a releasable manner to define between said base and said head a working chamber in said housing;

drive means for reciprocating said diaphragm;

port means on said head for providing material intake and discharge ports for said working chamber; and said head with fixedly attached diaphragm and port means forming an integral module removable as a unit from said base without detachment of the diaphragm.

19. A filling machine according to claim 18 wherein said diaphragm can be detached from said head to allow inspection of the interior of said working chamber and reattachment prior to mounting said head to said base.

20. A filling machine according to claim 19 wherein said head includes a recess receiving and providing a frictional fit for a flange of said diaphragm to be inserted to form said attachment.

21. A filling machine according to claim 19 wherein said diaphragm includes a radial side flange and including a first clamping means for removably attaching said diaphragm to said head and a second clamping means for removably attaching said head and affixed diaphragm to said base.

22. A filling machine according to claim 19 including a first clamping means for removably attaching said diaphragm to said head and second clamping means for removably attaching said head and affixed diaphragm to said body.

23. A filling machine according to claim 19 wherein an intake valve is provided for said intake port and a discharge valve is provided for said discharge port.

24. A filling machine according to claim 23 wherein said intake and discharge valves are mounted on said head.

25. A filling machine according to claim 23 wherein said intake and discharge valves are not mounted on said head and are fluidly connected to said head by tubing.

26. A filling machine according to claim 25 wherein said tubing is connected to said head by a T-connector.

27. A filling machine according to claim 18 wherein said base includes a vacuum port and seal means for sealing said base.

28. A filling machine according to claim 18 including a first clamping means on said base for removably mounting said module on said base.

29. A filling machine according to claim 28 wherein said module and said base each include a flange having a tapered surface received in a recess of said clamping means.

30. A filling machine according to claim 29 including a second clamping means for removably attaching said diaphragm to said head and including said tapered surface of said module received in said recess of said first clamping means.

31. A filling machine according to claim 18 wherein said diaphragm is attached to said head by an adhesive.

32. A filling machine according to claim 18 wherein said drive means includes a piston and a piston rod in said housing with a first end of said piston rod cooperating with said piston and a second end of said piston rod slidably extending from said base.

33. A filling machine according to claim 18 wherein said body is metal and said head is plastic.

34. A filling machine according to claim 18 wherein said body and said head are plastic.

35. A filling machine according to claim 18 wherein said filling machine transports a measured volume of material per cycle of operation.

36. A module for use with and to be removably attached to a base of a filling unit which transports material from a source to a container, said module comprising:

a head;

a flexible rolling diaphragm fixedly attached to said head and positioned to abut said base in a releasable sealable manner to define between said diaphragm and said head a working chamber;

port means on said head for providing material intake and discharge ports for said working chamber; and said head with fixedly attached diaphragm and port means forming an integral module attachable and removable as a unit from said base without detachment of the diaphragm.

37. A module according to claim 36 wherein said module is supplied and presterilized in a ready to use package.

38. A module according to claim 36 wherein said diaphragm can be detached from its fixed attachment to said head to allow inspection of the interior of said working chamber and reattachment prior to mounting said head to said base.

39. A module according to claim 36 wherein said head includes a recess which receives and provides a frictional fit for a flange of said diaphragm to be inserted to form said attachment of said diaphragm to said head.

40. A filling unit according to claim 36 wherein said diaphragm is attached to said head by an adhesive.

41. A method of preparing a filling unit, including a diaphragm secured between and abutting a base and a head, for a new material comprising the steps of:

removing a first head module, having a first diaphragm fixedly attached to a first head and first intake and discharge ports on stud first head, from said base without detachment of the diaphragm from the first head; and removably attaching a second head module, having a second diaphragm fixedly attached to a second head and second intake and discharge ports on said second head, to said base.

42. A method according to claim 41 including prior to removably attaching said second module:

inspecting said second head and diaphragm separated; and subsequently fixedly attaching said second diaphragm to said second head.

43. A method according to claim 42 including prior to removably attaching said second diaphragm to said second head, sterilizing said second head and diaphragm.

44. A module for use with and to be removably attached by a first clamping means to a base of a filling unit which transports material from a source to a container, said module comprising:

a head;

a flexible rolling diaphragm;

a second clamping means for removably attaching said diaphragm to said head independent of said first clamping means to define between said diaphragm and said head a working chamber;

port means on said head for providing material intake and discharge ports for said working chamber; and said head with fixedly attached diaphragm and port means forming an integral module attachable and removable as a unit from said base without detachment of the diaphragm.

* * * * *